US010088767B2

(12) United States Patent
Nishitera

(10) Patent No.: US 10,088,767 B2
(45) Date of Patent: Oct. 2, 2018

(54) ELECTROSTATIC LATENT IMAGE DEVELOPING TONER

(71) Applicant: KYOCERA Document Solutions Inc., Osaka (JP)

(72) Inventor: Haruhiro Nishitera, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/750,867

(22) PCT Filed: Apr. 14, 2017

(86) PCT No.: PCT/JP2017/015240
§ 371 (c)(1),
(2) Date: Feb. 7, 2018

(87) PCT Pub. No.: WO2017/195526
PCT Pub. Date: Nov. 16, 2017

(65) Prior Publication Data

US 2018/0224764 A1 Aug. 9, 2018

(30) Foreign Application Priority Data

May 12, 2016 (JP) ..... 2016-095963

(51) Int. Cl.
*G03G 9/087* (2006.01)
*G03G 9/08* (2006.01)

(52) U.S. Cl.
CPC ..... *G03G 9/08788* (2013.01); *G03G 9/0819* (2013.01); *G03G 9/08755* (2013.01); *G03G 9/08766* (2013.01); *G03G 9/08768* (2013.01); *G03G 9/08793* (2013.01)

(58) Field of Classification Search
CPC ..... G03G 9/08; G03G 9/087; G03G 9/08755; G03G 9/08766
See application file for complete search history.

(56) References Cited

FOREIGN PATENT DOCUMENTS

| | | | | |
|---|---|---|---|---|
| JP | 2008-83080 A | | 4/2008 | |
| WO | 2008/111726 | * | 9/2008 | ..... G03G 9/087 |

* cited by examiner

*Primary Examiner* — Hoa V Le
(74) *Attorney, Agent, or Firm* — Studebaker & Brackett PC

(57) ABSTRACT

An electrostatic latent image developing toner includes a plurality of toner particles containing a binder resin. The binder resin has an amide bond and an ester bond. An area ratio of a peak originated from C═O stretching of the amide bond to a peak originated from C═O stretching of the ester bond is at least 0.00010 and no greater than 0.02000 in a FT-IR spectrum of the toner obtained by Fourier transform infrared spectroscopy analysis. The toner has a storage elastic modulus at 80° C. of at least $3.5\times10^4$ Pa and no greater than $5.0\times10^4$ Pa. The toner has a storage elastic modulus at 120° C. of at least $1.0\times10^3$ Pa and no greater than $10\times10^4$ Pa. The toner has a storage elastic modulus at 150° C. of at least $1.0\times10^3$ Pa and no greater than $10\times10^4$ Pa.

10 Claims, 1 Drawing Sheet

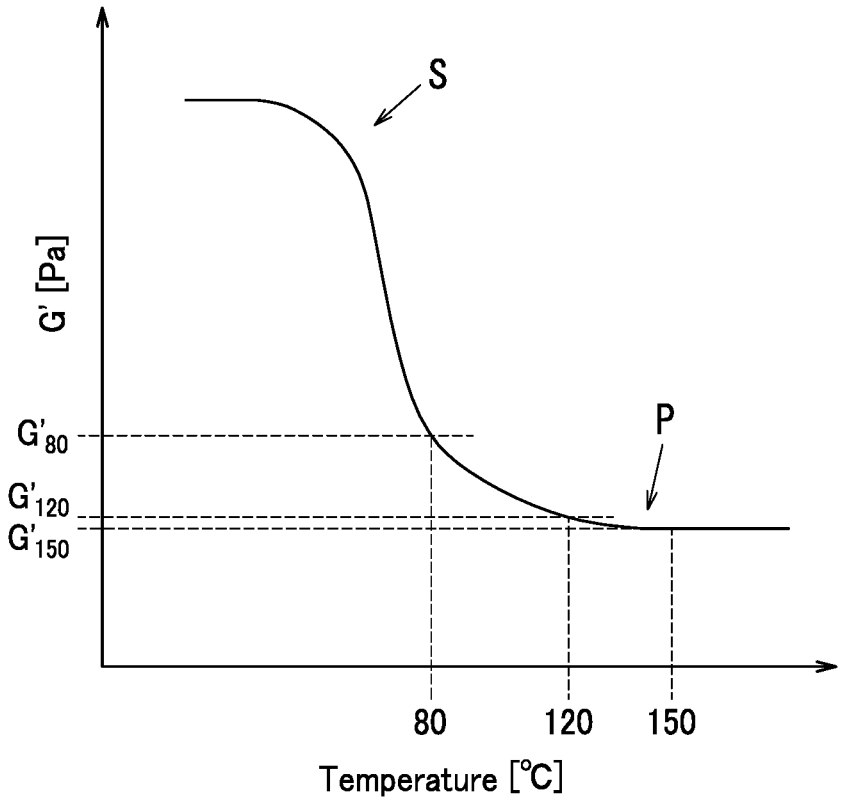
S
P
G' [Pa]
G'80
G'120
G'150
80
120
150
Temperature [°C]

ELECTROSTATIC LATENT IMAGE DEVELOPING TONER

TECHNICAL FIELD

The present invention relates to an electrostatic latent image developing toner.

BACKGROUND ART

Patent Literature 1 discloses an electrophotographic toner containing a crystalline polyester resin, a non-crystalline polyester resin, and an amide compound having a molecular weight of no greater than 1,000 and having three or more amide bonds.

CITATION LIST

Patent Literature

[Patent Literature 1] Japanese Patent Application Laid-Open Publication No. 2008-83080

SUMMARY OF INVENTION

Technical Problem

The crystalline polyester resin and the specific amide compound are necessary in the technique disclosed in Patent Literature 1. Further, a toner having sufficient low-temperature fixability cannot be obtained unless the crystalline polyester resin is contained in toner particles.

The present invention has been made in view of the foregoing and has its object of improving low-temperature fixability of a toner and inhibiting hot offset of the toner regardless of the presence or absence of a crystalline polyester resin.

Solution to Problem

An electrostatic latent image developing toner according to the present invention includes a plurality of toner particles containing a binder resin. The binder resin has an amide bond and an ester bond. An area ratio of a peak originated from C═O stretching of the amide bond to a peak originated from C═O stretching of the ester bond is at least 0.00010 and no greater than 0.02000 in a FT-IR spectrum of the toner obtained by Fourier transform infrared spectroscopy analysis. The toner has a storage elastic modulus at a temperature of 80° C. of at least $3.5\times10^4$ Pa and no greater than $5.0\times10^4$ Pa. The toner has a storage elastic modulus at a temperature of 120° C. of at least $1.0\times10^3$ Pa and no greater than $1.0\times10^4$ Pa. The toner has a storage elastic modulus at a temperature of 150° C. of at least $1.0\times10^3$ Pa and no greater than $1.0\times10^4$ Pa.

Advantageous Effects of Invention

According to the present invention, improvement in low-temperature fixability of a toner and inhibition of hot offset of the toner can be achieved regardless of the presence or absence of a crystalline polyester resin.

BRIEF DESCRIPTION OF DRAWINGS

FIGURE is a graph representation showing an example of a G'-temperature dependence curve of an electrostatic latent image developing toner according to an embodiment of the present invention.

DESCRIPTION OF EMBODIMENTS

Hereinafter, an embodiment of the present invention will be described. Note that evaluation results (values indicating shape, physical properties, or the like) for a powder (specific examples include toner mother particles, an external additive, and a toner) each are a number average value measured with respect to an appropriate number of average particles selected from the powder unless otherwise stated.

Unless otherwise stated, the number average particle diameter of a powder is a number average value of equivalent circle diameters of primary particles of the powder (diameters of circles having the same areas as projected areas of the respective particles) measured using a microscope. Values for volume median diameter ($D_{50}$) of a powder were measured using a laser diffraction/scattering particle size distribution analyzer ("LA-750" produced by HORIBA, Ltd.) unless otherwise stated. Glass transition points (Tg) were measured in accordance with "JIS (Japanese Industrial Standard) K7121-2012" using a differential scanning calorimeter ("DSC-6220" produced by Seiko Instruments Inc.) unless otherwise stated. Tg (glass transition point) corresponds to a temperature (i.e., onset temperature) at a point of change in specific heat (i.e., an intersection point of an extrapolation of the base line and an extrapolation of the inclined portion of the curve) on a heat absorption curve (vertical axis: heat flow (DSC signals), horizontal axis: temperature) in second temperature increase measured by the differential scanning calorimeter. Unless otherwise stated, softening points (Tm) were measured using a capillary rheometer ("CFT-500D" produced by Shimadzu Corporation). Tm (softening point) corresponds to a temperature at a point on an S-shaped curve (horizontal axis: temperature, vertical axis: stroke) measured using the capillary rheometer, at which point the stroke value is "((base line stroke value)+(maximum stroke value))/2".

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl. Furthermore, a crystalline polyester resin is referred to as a "crystalline polyester resin" and a non-crystalline polyester resin is referred simply to as a "polyester resin".

A toner according to the present embodiment can be favorably used for example as a positively chargeable toner for development of an electrostatic latent image. The toner according to the present embodiment is a powder including a plurality of toner particles (particles each having a later-described configuration). The toner may be used as a one-component developer. Alternatively, a two-component developer may be prepared by mixing the toner and a carrier using a mixer (e.g., a ball mill). A ferrite carrier (powder of ferrite particles) is preferably used as the carrier in order that high-quality images are formed. Magnetic carrier particles each including a carrier core and a resin layer covering the carrier core are preferably used for formation of high-quality images for a long period of term. In order to impart magnetism to the carrier particles, carrier cores may be made from a magnetic material (e.g., a ferromagnetic material such as ferrite) or a resin in which magnetic particles are dispersed. Alternatively, magnetic particles may be dispersed in the resin layers covering the respective carrier cores. The amount of the toner in the two-component developer is preferably at least 5 parts by mass and no greater than 15 parts by mass relative to 100 parts by mass of the carrier in order that high-quality images are formed. Note that the positively chargeable toner is positively charged by friction with the carrier.

The toner according to the present embodiment can be used for example for image formation using an electrophotographic apparatus (e.g., image forming apparatus). The following describes an example of an image forming method using an electrophotographic apparatus.

First, an image forming section (e.g., a charger and a light exposure device) of the electrophotographic apparatus forms an electrostatic latent image on a photosensitive member (e.g., a surface layer portion of a photosensitive drum) based on image data. Subsequently, a development device (specifically, a development device loaded with developer including toner) of the electrophotographic apparatus develops the electrostatic latent image formed on the photosensitive member by supplying the toner to the photosensitive member. The toner is charged by friction with carrier, a development sleeve, or a blade in the development device before being supplied to the photosensitive member. For example, a positively chargeable toner is charged positively. In a development process, a toner image is formed on the photosensitive member in a manner that toner (specifically, triboelectrically charged toner) on the development sleeve (e.g., a surface layer portion of a development roller in the development device) disposed in the vicinity of the photosensitive member is supplied to the photosensitive member and attached to the electrostatic latent image on the photosensitive member. The development device is replenished with toner for replenishment use from a toner container accommodating the toner for compensation of consumed toner.

In a subsequent transfer process, a transfer device of the electrophotographic apparatus transfers the toner image on the photosensitive member to an intermediate transfer member (e.g., a transfer belt) and further transfers the toner image on the intermediate transfer member to a recording medium (e.g., paper). Thereafter, a fixing device (fixing method: nip fixing using a heating roller and a pressure roller) of the electrophotographic apparatus applies heat and pressure to the toner to fix the toner to the recording medium. As a result, an image is formed on the recording medium. For example, a full color image can be formed by superimposing toner images in four colors of black, yellow, magenta, and cyan. Note that the transfer process may be a direct transfer process by which the toner image on the photosensitive member is transferred directly to the recording medium not via the intermediate transfer member. Also, a belt fixing method may be employed as the fixing method.

The toner according to the present embodiment includes a plurality of toner particles. The toner particles may include an external additive. In a configuration in which the toner particles include the external additive, the toner particles each include a toner mother particle and the external additive. The external additive is attached to surfaces of the toner mother particles. The toner mother particles contain a binder resin. The toner mother particles may contain an internal additive (for example, at least one of a releasing agent, a colorant, a charge control agent, and a magnetic powder) in addition to the binder resin depending on necessity. The external additive may be omitted if unnecessary. In a configuration in which the external additive is omitted, the toner mother particles and the toner particles are equivalent.

The toner particles included in the toner according to the present embodiment may each be a toner particle not provided with a shell layer (also referred to below as a non-capsule toner particle) or a toner particle provided with a shell layer (also referred to below as a capsule toner particle). The toner mother particles of the capsule toner particles each include a core and a shell layer covering a surface of the core. The shell layer is substantially constituted by a resin. For example, when cores that melt at low temperature are each covered with a shell layer excellent in heat resistance, the toner can have both heat-resistant preservability and low-temperature fixability. An additive may be dispersed in the resin constituting the shell layer. The shell layers may entirely or partly cover the surfaces of the cores. Preferably, the cores of the capsule toner particles are substantially constituted by a thermoplastic resin in order to improve fixability of the toner. Toner mother particles of non-capsule toner particles, which will be described later, can be used as the cores of the capsule toner particles. The shell layers may be substantially constituted by a thermosetting resin, a thermoplastic resin, or both of the thermoplastic resin and the thermosetting resin.

The toner according to the present embodiment is an electrostatic latent image developing toner having the following basic features.

(Basic Features of Toner)

The electrostatic latent image developing toner includes a plurality of toner particles containing a binder resin. The binder resin has an amide bond and an ester bond. An area ratio of a second peak originated from C═O stretching of the amide bond to a first peak originated from C═O stretching of the ester bond (also referred to below as an A/E ratio) is at least 0.00010 and no greater than 0.02000 in a FT-IR spectrum of the toner obtained through Fourier transform infrared spectroscopy analysis. The toner has a storage elastic modulus at a temperature of 80° C. (also referred to below as a storage elastic modulus $G'_{80}$) of at least $3.5\times10^4$ Pa and no greater than $5.0\times10^4$ Pa. The toner has a storage elastic modulus at a temperature of 120° C. (also referred to below as a storage elastic modulus $G'_{120}$) of at least $1.0\times10^3$ Pa and no greater than $1.0\times10^4$ Pa. The toner has a storage elastic modulus at a temperature of 150° C. (also referred to below as a storage elastic modulus $G'_{150}$) of at least $1.0\times10^3$ Pa and no greater than $1.0\times10^4$ Pa. Methods for measuring the A/E ratio and the storage elastic moduli are the same as those described in Examples below or an alternative method thereof.

A toner that can be firmly fixed even in low-temperature fixing and that causes no hot offset (toner attachment to the heating roller) even in high-temperature fixing is preferable as a toner to be fixed by nip fixing. More specifically, it is preferable that the toner to be fixed by nip fixing is appropriately fixed both in low-temperature fixing using a pressure roller at 80° C. and a heating roller at 120° C. and in high-temperature fixing using a pressure roller at 120° C. and a heating roller at 150° C. The toner such as above can be fixed in a wide range of temperature.

The present inventor confirmed by experiments and the like that a toner to be fixed by nip fixing basically exhibits the following behavior although receiving influence of affinity between the binder resin and a recording medium (e.g., paper) to some extent.

In a situation in which a toner on a recording medium (e.g., printing paper) is heated to reduce the storage elastic modulus of the toner, the toner is fixed to the recording medium when the storage elastic modulus thereof is no greater than $5.0\times10^4$ Pa. Even when the storage elastic modulus of the toner becomes $1.0\times10^4$ Pa by further reducing the storage elastic modulus thereof, a fixing condition of the toner to the recording medium is maintained. However, when the storage elastic modulus of the toner becomes less than $1.0\times10^3$ Pa, the toner loses its self-aggregation property, thereby causing hot offset.

As described above, when the storage elastic modulus of the toner at 80° C. (temperature of the pressure roller in the aforementioned low-temperature fixing) can be reduced to no greater than $5.0\times10^4$ Pa (also referred to below as a fixing level), low-temperature fixability of the toner can be improved. However, when the storage elastic modulus of the toner at 120° C. (temperature of the heating roller in the aforementioned low-temperature fixing and temperature of the pressure roller in the aforementioned high-temperature fixing) or 150° C. (temperature of the heating roller in the aforementioned high-temperature fixing) becomes less than $1.0\times10^3$ Pa (also referred to below as a H. O. level), hot offset of toner is liable to readily occur. Typically, a resin of which storage elastic modulus reduces to the fixing level in low temperatures (80° C.) has a storage elastic modulus that reduces to the H. O. level in high temperatures (120° C. or 150° C.). A resin of which storage elastic modulus does not reach the H.O. level in high temperatures (120° C. or 150° C.) has a storage elastic modulus that does not reduce to the fixing level in low temperatures (80° C.). The present inventor found that when the binder resin has an amide bond (—C(═O)NH—) and an ester bond (—C(═O)—O—) and has an A/E ratio of at least 0.00010 and no greater than 0.02000, elasticity of the toner can sufficiently reduce in low temperatures and be maintained sufficiently high even in high temperatures.

Specifically, introduction of a cross-linking structure (mesh structure) into the binder resin through amide bonding and ester bonding can result in a toner in a rubber state in which elasticity can be maintained high even in high temperatures. The cross-linking structure introduced into the resin includes a cross-linking structure formed by covalent bonding of nitrogen atoms in the amide bond (also referred to below as chemical cross-linkage) and a cross-linking structure formed by hydrogen bonding of oxygen atoms in the ester bond (also referred to below as a physical cross-linkage). The nitrogen atom (N) has high electronegativity in the amide bond (—C(═O)NH—). The hydrogen atom (H) that is covalently bonded to the nitrogen atom is accordingly polarized to have a slightly positive charge (+δ). The hydrogen atom (H) forms a hydrogen bond to a lone electron pair of the oxygen atom (O) in the ester bond (—C(═O)—O—), resulting in formation of the physical cross-linkage in the binder resin.

A portion of the resin that has the chemical cross-linkage is thought to hardly flow unless chemical change occurs. For the reason as above, even when only the ratio of the chemical cross-linkage in the resin (cross-linking degree) is adjusted, it is difficult to inhibit hot offset of the toner and improve low-temperature fixability of the toner. When the resin is heated and melted, a portion of the resin having the physical cross-linkage flows to some extent but does not excessively flow. The present inventor invented a toner having the aforementioned basic features by focusing attention on the characteristics of the physical cross-linkage as above. The ratio of the physical cross-linkage in the resin (cross-linking degree) can be adjusted according to the A/E ratio (=(area of second peak)/(area of first peak)). When the A/E ratio is excessively large, it is difficult to ensure sufficient low-temperature fixability of the toner. When the A/E ratio is excessively small, hot offset of the toner is liable to readily occur. Note that the respective positions of the first and second peaks may vary according to the type of an electron-attracting group or an electron-releasing group present in the vicinity of each of the amide bond and the ester bond.

The toner having the above basic features has a storage elastic modulus $G'_{80}$ of at least $3.5\times10^4$ Pa and no greater than $5.0\times10^4$ Pa, a storage elastic modulus $G'_{120}$ of at least $1.0\times10^3$ Pa and no greater than $1.0\times10^4$ Pa, and a storage elastic modulus $G'_{150}$ of at least $1.0\times10^3$ Pa and no greater than $1.0\times10^4$ Pa. In the above configuration, the storage elastic modulus of the toner having the above basic features reduces to no greater than $5.0\times10^4$ Pa (fixing level) at 80° C. and does not become less than $1.0\times10^3$ Pa (H. O. level) both at 120° C. and 150° C. According to the toner having the above basic features, inhibition of hot offset of the toner and improvement in low-temperature fixability of the toner can be achieved.

FIGURE shows an example of a G'-temperature dependence curve (vertical axis: storage elastic modulus, horizontal axis: temperature) of the toner having the above basic features. FIGURE shows temperature dependence of the storage elastic modulus of the toner in a temperature range between 40° C. and 200° C. Specifically, FIGURE shows results of measurement in which the storage elastic moduli of the toner were measured at respective temperatures using a rheometer under a condition of a frequency of 1 Hz while the temperature of the toner was increased at a specific rate (heating rate: 2° C./minute) from 40° C. In the G'-temperature dependence curve shown in FIGURE, the storage elastic modulus reduces as the temperature of the toner is increased. A shoulder S and a saturation point P appear on the G'-temperature dependence curve. The temperature of the saturation point P may be referred to below as a "saturation temperature". When the temperature of the toner is increased from 40° C., the storage elastic modulus of the toner starts reducing sharply from a time point at which the temperature of the toner reaches the temperature of the shoulder S. After the storage elastic modulus of the toner reduces at such a sharp rate of change for a while, the rate of change gradually reduces and the storage elastic modulus of the toner does not change at and after the saturation point P. The rate of change (corresponding to an inclination of the G'-temperature dependence curve) in the storage elastic modulus of the toner sharply changes at the temperature of the shoulder S. The shoulder S appears at a temperature lower than 80° C. on the G'-temperature dependence curve shown in FIGURE. The storage elastic modulus of the toner becomes constant in a temperature range after the saturation point P (i.e., temperature of at least the saturation temperature). The saturation point P appears in a temperature range between 120° C. and 150° C. on the G'-temperature dependence curve in FIGURE. Note that in a situation in which a part (one point) where the inclination sharply changes cannot be definitely determined on the G'-temperature dependence curve, an intersection point between a tangent of a curved portion before the inclination sharply changes and a tangent of a curved portion after the inclination sharply changes is determined to be a shoulder.

In order that the toner has the aforementioned basic features, the toner particles particularly preferably contain as the binder resin a polyester resin having the ester bond and a polymer of a vinyl compound bonded to the polyester resin through the amide bond. Note that the polymer of the vinyl compound may be a copolymer of two or more vinyl compounds.

The polymer of the vinyl compound includes a repeating unit derived from the vinyl compound. Note that the vinyl compound is a compound having a vinyl group ($CH_2$═CH—) or a vinyl group in which hydrogen is substituted. Examples of the vinyl compound include ethylene, propylene, butadiene, vinyl chloride, acrylic acid, acrylic acid ester, methacrylic acid, methacrylic acid ester, acrylonitrile, and styrene. The vinyl compound can be a macromolecule (resin) by addition polymerization ("C═C"→"—C—C—") through carbon double bonding "C═C".

In order to bond the polyester resin and the polymer of the vinyl compound together through the amide bond, it is particularly preferable to melt-knead a polymer of a vinyl compound including a repeating unit represented by the following formula (1-1) (also referred to below as a repeating unit (1-1)) together with the polyester resin. An aqueous solution of oxazoline group-containing macromolecule ("EPOCROS (registered Japanese trademark) WS Series" produced by NIPPON SHOKUBAI CO., LTD.) can for example be used as the polymer of the vinyl compound inc1uding the repeating unit (1-1). "EPOCROS WS-300" and "EPOCROS WS-700" each include a polymer of monomers (resin raw materials) including 2-vinyl-2-oxazoline and at least one type of alkyl ester (meth)acrylate.

(1-1)

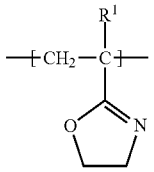

In formula (1-1), $R^1$ represents a hydrogen atom or an optionally substituted alkyl group (in the form of straight chain, branched chain, or ring). Particularly preferable $R^1$ is a hydrogen atom or a methyl group.

The repeating unit (1-1) has a ring-unopened oxazoline group. The ring-unopened oxazoline group has a ring structure and exhibits high positive chargeability. The ring-unopened oxazoline group tends to react with a carboxyl group, an aromatic sulfanyl group, and an aromatic hydroxyl group. When the repeating unit (1-1) reacts for example with a carboxyl group of the polyester resin (represented by $R^0$ in formula (1-2)), the oxazoline group is ring-opened as shown in the following formula (1-2) to form an amide ester bond. The repeating unit represented by formula (1-2) is referred to below as a repeating unit (1-2).

(1-2)

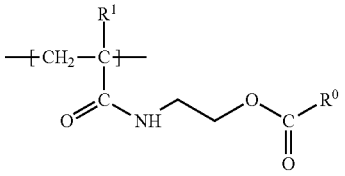

In formula (1-2), $R^1$ represents the same group as that represented by $R^1$ in formula (1-1) and "$R^0$—COO—" represents a terminal of an acid component of the polyester resin. The oxazoline group in the repeating unit (1-1) and the carboxyl group in the acid component of the polyester resin react together to form a covalent bond, thereby forming the repeating unit (1-2).

In order to inhibit hot offset of the toner and improve low-temperature fixability of the toner, the toner particles preferably contain a polyester resin having an ester bond and a polymer including the repeating unit (1-1). In addition, the polyester resin and the polymer including the repeating unit (1-1) are preferably bonded together in the form represented by formula (1-2) through ring opening of oxazoline groups in at least a portion of molecules of the repeating unit (1-1) included in the polymer. The binder resin of the toner particles particularly preferably includes the repeating units (1-1) and (1-2) in order to obtain a toner excellent in positive chargeability. When the ring-opening reaction of the oxazoline group is controlled, the amount of the amide bond introduced into the polyester resin can be adjusted.

In order to inhibit hot offset of the toner and improve low-temperature fixability of the toner, an absolute value of a difference between the storage elastic modulus of the toner at temperature of 120 ° C. and that of the toner at temperature of 150° C. is preferably no greater than $1.0\times10^3$ Pa. Reduction in storage elastic modulus of the toner almost saturates at around 150° C. It can be accordingly thought that inhibition of hot offset of the toner can be further ensured. A value obtained by subtracting the storage elastic modulus of the toner at a temperature of 150° C. from that of the toner at a temperature of 120° C. ($=G'_{120}-G'_{150}$) is preferably at least $+0.1\times10^3$ Pa and no greater than $+0.3\times10^3$ Pa in order to obtain a toner that can be fixed at sufficiently low temperature and in a sufficiently wide temperature range. That is, it is preferable that the storage elastic modulus $G'_{120}$ is greater than the storage elastic modulus $G'_{150}$ and an absolute value of the difference therebetween is at least $0.1\times10^3$ Pa and no greater than $0.3\times10^3$ Pa (see a later-described toner TA-4, for example). The toner having the above configuration is thought to have a saturation point at around 120° C.

In order to inhibit hot offset of the toner and improve low-temperature fixability of the toner, an absolute value of a difference between the storage elastic modulus of the toner at temperature of 80° C. and that of the toner at temperature of 120° C. is preferably at least $3.0\times10^4$ Pa. The toner reduces in its elasticity by being heated, with a result that the heated toner tends to readily permeate through and be fixed to a recording medium.

It is further preferable that the storage elastic modulus of the toner at a temperature of 120° C. is at least $2.0\times10^3$ Pa and no greater than $5.0\times10^3$ Pa and the storage elastic modulus of the toner at a temperature of 150° C. is at least $1.0\times10^3$ Pa and no greater than $5.0\times10^3$ Pa in order to improve fixability of the toner in high-temperature fixing.

Toners are typically categorized into a pulverized toner and a polymerized toner (also called a chemical toner). A toner produced by a pulverization method belongs to the pulverized toner, and a toner produced by an aggregation method belongs to the polymerized toner. The toner having the above basic features preferably belongs to the pulverized toner. The toner particles particularly preferably contain a melt-knead polyester resin (specifically, a non-crystalline polyester resin) and a polymer including an oxazoline group (e.g., a polymer having a repeating unit represented by the above formula (1-1)). The toner mother particles particularly preferably contain the polymer including an oxazoline group at a ratio of at least 0.05% by mass and no greater than 7.00% by mass.

The toner mother particles preferably have a volume median diameter ($D_{50}$) of at least 4 μm and no greater than 9 μm in order that the toner has both heat-resistant preservability and low-temperature fixability.

The toner preferably includes toner particles containing a binder resin having an amide bond and an ester bond at a ratio of at least 70% by number in order to obtain a toner suitable for image formation, more preferably at least 90% by number, and further preferably 100% by number.

The following describes a preferable example of a configuration of non-capsule toner particles. The toner mother particles and the external additive will be described in stated order. An unnecessary component may be omitted according to use of the toner.

(Toner Mother Particles)

(Binder Resin)

Typically, the binder resin accounts for most (e.g., 85% by mass or more) of the components of the toner mother particles. Properties of the binder resin are therefore expected to have great influence on an overall property of the toner mother particles. Combinational use of plural types of resins as the binder resin can result in adjustment of properties (specific examples include a hydroxyl value, an acid value, a Tg, and a Tm) of the binder resin. In a configuration in which the binder resin has an ester group, an ether group, an acid group, or a methyl group, the toner mother particles are highly likely to be anionic. In a configuration in which the binder resin has an amino group or an amide group, the toner mother particles are highly likely to be cationic.

The toner mother particles preferably contain a polyester resin having an ester bond and a polymer including an oxazoline group in order that the toner has the above basic features. A polymer of a vinyl compound is preferable as the polymer including an oxazoline group, and a polymer of monomers (resin raw materials) including vinyl oxazoline and alkyl ester (meth)acrylate having an alkyl group having a carbon number of at least 1 and no greater than 4 at an ester portion is particularly preferable.

The polyester resin is obtained by condensation polymerization of one or more polyhydric alcohols and one or more polybasic carboxylic acids. The polyester resin contains an alcohol component and an acid component. Examples of alcohols that can be preferably used for synthesis of the polyester resin include the following dihydric alcohols (specific examples include aliphatic diols and bisphenols) and tri- or higher-hydric alcohols. Examples of carboxylic acids that can be preferably used for synthesis of the polyester resin include the following dibasic carboxylic acids and tri- or higher-basic carboxylic acids.

Preferable examples of the aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecane diol), 2-butene-1,4-diol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenylsuccinic acids (specific examples include n-butenylsuccinic acid, isobutenylsuccinic acid, n-octenylsuccinic acid, n-dodecenylsuccinic acid, and isododecenylsuccinic acid), unsaturated dicarboxylic acids (specific examples include maleic acid, fumaric acid, citraconic acid, itaconic acid, and glutaconic acid), and cycloalkane dicarboxylic acids (a specific example is cyclohexanedicarboxylic acid).

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Preferable examples of the polyester resin contained in the toner mother particles together with the polymer including an oxazoline group include non-crystalline polyester resins containing an aliphatic diol having a carbon number of at least 1 and no greater than 4 as an alcohol component and an aromatic dicarboxylic acid as an acid component.

In order to improve low-temperature fixability of the toner, a crystalline polyester resin may be contained in the toner mother particles. However, it can be thought that sufficient low-temperature fixability can be ensured even in a configuration in which the toner mother particles of the toner having the above basic features contain no crystalline polyester resin.

The toner mother particles may optionally contain a resin other than the polyester resin as a binder resin. Examples of the binder resin other than the polyester resin include thermoplastic resins such as styrene-based resin, acrylic acid-based resins (specific examples include acrylic acid ester polymer and methacrylic acid ester polymer), olefin-based resins (specific examples include polyethylene resin and polypropylene resin), vinyl chloride resin, polyvinyl alcohol, vinyl ether resin, N-vinyl resin, polyamide resin, and urethane resin. Copolymers of the above-listed resins, that is, copolymers of the resins into which any repeating unit is introduced (specific examples include styrene-acrylic acid-based resin and styrene-butadiene-based resin) can be preferably used also as the binder resin.

(Colorant)

The toner mother particles may optionally contain a colorant. The colorant can be a known pigment or dye that matches the color of the toner. The amount of the colorant is preferably at least 1 part by mass and no greater than 20 parts by mass relative to 100 parts by mass of the binder resin.

The toner mother particles may contain a black colorant. Carbon black can be used as a black colorant. The black colorant may be a colorant of which color is adjusted to black using a yellow colorant, a magenta colorant, and a cyan colorant.

The toner mother particles may contain a non-black colorant such as a yellow colorant, a magenta colorant, or a cyan colorant.

Examples of yellow colorants that can be used include at least one compound selected from the group consisting of condensed azo compounds, isoindolinone compounds, anthraquinone compounds, azo metal complexes, methine compounds, and arylamide compounds. Specific examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

Examples of magenta colorants that can be used include at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of magenta colorants that can be preferably used include C.I. Pigment Red (for example, 2, 3, 5, 6, 7, 19, 23, 48:2, 48:3, 48:4, 57:1, 81:1, 122, 144, 146, 150, 166, 169, 177, 184, 185, 202, 206, 220, 221, or 254).

Examples of cyan colorants that can be used include at least one compound selected from the group consisting of copper phthalocyanine compounds, anthraquinone compounds, and basic dye lake compounds. Specific examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particles may optionally contain a releasing agent. The releasing agent is for example used in order to improve fixability of the toner or resistance of the toner to being offset. The amount of the releasing agent is preferably at least 1 part by mass and no greater than 30 parts by mass relative to 100 parts by mass of the binder resin in order to improve fixability or offset resistance of the toner.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymers of polyethylene oxide waxes; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax. One type of releasing agent may be used or a combination of two or more types of releasing agents may be used.

A compatibilizer may be added to the toner mother particles in order to improve compatibility between the binder resin and the releasing agent.

(Charge Control Agent)

The toner mother particles may optionally contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner mother particles can be increased through the toner mother particles containing a negatively chargeable charge control agent (specific examples include an organic metal complex and a chelate compound). The cationic strength of the toner mother particles can be increased through the toner mother particles containing a positively chargeable charge control agent (specific examples include pyridine, nigrosine, and quaternary ammonium salt). However, in a configuration in which sufficient chargeability of the toner can be ensured, the toner mother particles need not contain a charge control agent.

(Magnetic Powder)

The toner mother particles may optionally contain a magnetic powder. Examples of materials of the magnetic powder that can be preferably used include ferromagnetic metals (specific examples include iron, cobalt, nickel, and alloys containing at least one of them), ferromagnetic metal oxides (specific examples include ferrite, magnetite, and chromium dioxide), and materials subjected to ferromagnetization (a specific example is a carbon material to which ferromagnetism is imparted through heat treatment). One type of magnetic powder may be used or a combination of two or more types of magnetic powders may be used.

[External Additive]

An external additive (specifically, a powder including a plurality of external additive particles) may be attached to surfaces of the toner mother particles. Unlike an internal additive, the external additive is not present inside the toner mother particles and is selectively present on the surfaces of the toner mother particles (surface layer portions of the toner mother particles). For example, when the toner mother particles (powder) and the external additive (powder) are stirred together, the external additive is attached to the surfaces of the toner mother particles. The toner mother particles and the external additive particles do not chemically react with each other and are bonded together physically rather than chemically. Bonding strength between the toner mother particles and the external additive particles can be adjusted through adjustment of the particle diameter, particle shape, and surface condition of the external additive particles and stirring conditions (specific examples include a stirring period and rotation speed for stirring).

The amount of the external additive is preferably at least 0.5 parts by mass and no greater than 10 parts by mass relative to 100 parts by mass of the toner mother particles in order to inhibit detachment of the external additive particles from the toner mother particles and cause the external additive to sufficiently exhibit functions.

The external additive particles are preferably inorganic particles and particularly preferably silica particles or particles of a metal oxide (specific examples include alumina, titanium oxide, magnesium oxide, zinc oxide, strontium titanate, and barium titanate). Resin particles can be used as the external additive particles. The external additive particles may be subjected to surface treatment. One type of external additive may be used or a combination of two or more types of external additives may be used.

In order to improve fluidity of the toner, inorganic particles (a powder) having a number average primary particle diameter of at least 5 nm and no greater than 30 nm are preferably used as the external additive particles. Resin particles (a powder) having a number average primary particle diameter of at least 50 nm and no greater than 200 nm are preferably used as the external additive particles in order to allow the external additive to function as a spacer among the toner particles for improving heat-resistant preservability of the toner.

[Toner Production Method]

In order to easily and favorably produce the toner having the above basic features, a toner production method preferably includes for example a melt-kneading process, a pulverization process, and an external addition process as described below.

(Melt-Kneading Process)

An example of the melt-kneading process will be described below. In the melt-kneading process, toner materials (for example, a binder resin, a colorant, a releasing agent, and an amide bond introducing agent) are mixed to obtain a mixture. The resulting mixture is melt-kneaded to obtain a melt-kneaded substance. A mixer (e.g., an FM mixer) can be favorably used for mixing the toner materials. A two-axis extruder, a triple roll kneader, or a double roll kneader can be favorably used for melt-kneading the mixture. A masterbatch containing a binder resin and a colorant may be used as a toner material.

(Pulverization Process)

An example of the pulverization process will be described below. First, the melt-kneaded substance is cooled to be solidified using a cooling and solidifying apparatus such as a drum flaker. Subsequently, the resulting solidified substance is coarsely pulverized using a first pulverizer. The resulting coarsely pulverized substance is further pulverized using a second pulverizer to obtain a powder having a desired particle diameter. The obtained pulverized substance may be classified.

(External Addition Process)

An external additive may be attached to the surfaces of the toner mother particles. When the toner mother particles and the external additive are mixed together using a mixer under a condition such that the external additive is not buried in the toner mother particles, the external additive can be attached to the surfaces of the toner mother particles.

Through the above processes, a toner including multiple toner particles can be produced. Note that non-essential processes may alternatively be omitted. For example, in a situation in which a commercially available product can be directly used as a material, use of the commercially available product can omit a process of preparing the material. In a configuration in which an external additive is not attached to the surfaces of the toner mother particles (i.e., the external addition process is omitted), the toner mother particles and the toner particles are equivalent. In order to obtain a desired compound, salt, ester, hydrate, or anhydride of the compound may be used as a material of the compound. Preferably, a large number of the toner particles are formed at the same time in order to produce the toner efficiently. The toner particles produced at the same time are considered to have substantially the same configuration.

EXAMPLES

The following describes examples of the present invention. Table 1 lists toners TA-1 to TA-5 and TB-1 to TB-4 according to Examples and Comparative Examples (each of which is an electrostatic latent image developing toner).

TABLE 1

| Toner | Oxazoline group-containing macromolecule (% by mass) | A/E ratio | Storage elastic modulus [Pa] $G'_{80}$ | $G'_{120}$ | $G'_{150}$ |
|---|---|---|---|---|---|
| TA-1 | 0.05 | 0.00011 | $4.1 \times 10^4$ | $2.1 \times 10^3$ | $1.1 \times 10^3$ |
| TA-2 | 0.20 | 0.00052 | $4.1 \times 10^4$ | $2.3 \times 10^3$ | $1.8 \times 10^3$ |
| TA-3 | 1.00 | 0.00249 | $4.2 \times 10^4$ | $3.4 \times 10^3$ | $2.9 \times 10^3$ |
| TA-4 | 2.00 | 0.00582 | $4.4 \times 10^4$ | $4.2 \times 10^3$ | $4.0 \times 10^3$ |
| TA-5 | 7.00 | 0.01920 | $4.6 \times 10^4$ | $4.9 \times 10^3$ | $5.0 \times 10^3$ |
| TB-1 | 0.00 | 0.00000 | $4.8 \times 10^4$ | $1.8 \times 10^3$ | $0.4 \times 10^3$ |
| TB-2 | 0.00 | 0.00000 | $5.6 \times 10^4$ | $2.0 \times 10^3$ | $0.8 \times 10^3$ |
| TB-3 | 0.03 | 0.00007 | $4.8 \times 10^4$ | $2.0 \times 10^3$ | $0.6 \times 10^3$ |
| TB-4 | 10.0 | 0.02482 | $5.8 \times 10^4$ | $5.1 \times 10^3$ | $6.0 \times 10^3$ |

Production methods, evaluation methods, and evaluation results for the respective toners TA-1 to TA5 and TB-1 to TB-4 will be described in stated order. In evaluations in which errors may occur, an evaluation value was calculated by calculating the arithmetic mean of an appropriate number of measured values in order to ensure that any errors were sufficiently small.

[Toner Production Method]

(Synthesis of Polyester Resin)

A 5-L reaction vessel equipped with a thermometer (thermocouple), a dewatering conduit, a nitrogen inlet tube, a fractionator, and a stirrer was set in an oil bath, and 1,200 g of propanediol, 1,700 g of terephthalic acid, and 3 g of esterified catalyst (tin(II) 2-ethylhexanoate) were added to the vessel. Subsequently, the internal temperature of the vessel was increased to 230° C. using the oil bath to allow the vessel contents to react (specifically, condensation reaction) for 15 hours under a condition of a temperature of 230° C. in a nitrogen atmosphere. Subsequently, the internal pressure of the vessel was reduced and the vessel contents were allowed to react in a reduced pressure atmosphere (pressure 8.0 kPa) at a temperature of 230° C. until a reaction product (polyester resin) had a Tm of a specific temperature (90° C.). As a result, a polyester resin having a Tm of 90° C. was obtained.

(Production of Toner Mother Particles)

An FM mixer ("FM-20B" produced by Nippon Coke & Engineering Co., Ltd.) was used to mix 80 parts by mass of a binder resin (polyester resin synthesized by the above-described manner), 9 parts by mass of a releasing agent (an ester wax: "NISSAN ELECTOL (registered Japanese trademark) WEP-9" produced by NOF Corporation), 9 parts by mass of a colorant (carbon black: "MA-100" produced by Mitsubishi Chemical Corporation), and an aqueous solution of oxazoline group-containing macromolecule ("EPOCROS WS-700" produced by NIPPON SHOKUBAI CO., LTD., solid concentration: 25% by mass). The aqueous solution of oxazoline group-containing macromolecule (EPOCROS WS-700) was added in an amount corresponding to the ratio of the oxazoline group-containing macromolecule (ratio defined for each toner) indicated in Table 1. In production of for example the toner TA-1, approximately 0.2 parts by mass of the aqueous solution of oxazoline group-containing macromolecule (EPOCROS WS-700) was added so that the oxazoline group-containing macromolecule had a ratio of 0.05% by mass (see Table 1) to the total amount of all the materials (the binder resin, the releasing agent, the colorant, and the aqueous solution of oxazoline group-containing macromolecule). Note that in a situation in which 0.2 parts by mass of the aqueous solution of oxazoline group-containing macromolecule (EPOCROS WS-700) is added, the amount of the oxazoline group-containing macromolecule is "0.2 parts by mass (additive amount of aqueous solution)× 0.25 (solid concentration)=0.05 parts by mass". The total amount of all the materials forming the toner mother particles was 98.05 (=80+9+9+0.05), and the ratio of the oxazoline group-containing macromolecule to the total amount was 0.05% by mass (=100×0.05/98.05).

Subsequently, the resulting mixture was melt-kneaded using a twin-screw extruder ("PCM-30" produced by Ikegai Corp.) under conditions of a material feeding speed of 100 g/minute, a shaft rotation speed of 150 rpm, and a cylinder temperature of 100° C. The resulting melt-kneaded substance was subsequently cooled. The cooled melt-kneaded substance was then coarsely pulverized using a pulverizer ("ROTOPLEX (registered Japanese trademark)" produced by Hosokawa Micron Corporation) under a condition of a set particle diameter of 2 mm. The resulting coarsely pulverized substance was then finely pulverized using a pulverizer ("Turbo Mill Model RS" produced by FREUND-TURBO CORPORATION). The resulting finely pulverized substance was classified using a classifier (classifier utilizing Coanda effect, "Elbow Jet Model EJ-LABO" produced by Nittetsu Mining Co., Ltd.). Through the above, toner mother particles having a volume median diameter ($D_{50}$) of 6.7 μm, a Tm of 90° C., and a Tg of 48° C. were obtained. The resulting toner mother particles contained the oxazoline group-containing macromolecule (polymer including an oxazoline group) at a ratio indicated in the column titled "Oxazoline group-containing macromolecule" in Table 1.

(External Addition Process) Subsequently, external addition was performed on the resulting toner mother particles. Specifically, 100 parts by mass of the toner mother particles and 1 part by mass of dry silica fine particles ("AEROSIL (registered Japanese trademark) REA90" produced by Nippon Aerosil Co., Ltd.) were mixed together for five minutes using a 10-L FM mixer (product of Nippon Coke & Engineering Co., Ltd.) to attach the external additive (silica particles) to the surfaces of the toner mother particles. The resulting powder was sifted using a 200-mesh sieve (opening 75 μm). As a result, a toner (each of the toners TA-1 to TA-5 and TB-1 to TB-4 listed in Table 1) including multiple toner particles was produced.

Measurement results of the A/E ratio and the storage elastic moduli $G'_{80}$, $G'_{120}$, and $G'_{150}$ for the toners TA-1 to TA-5 and TB-1 to TB-4 produced as above were as listed in Table 1. For example, the toner TA-1 had an A/E ratio of 0.00011, a storage elastic modulus $G'_{80}$ of $4.1\times10^4$ Pa, a storage elastic modulus $G'_{120}$ of $2.1\times10^3$ Pa, and a storage elastic modulus $G'_{150}$ of $1.1\times10^3$ Pa. The A/E ratio and the storage elastic moduli were measured by the following methods.

<A/E Ratio Measuring Method>

A measuring device used was a Fourier transform infrared spectrophotometer (FT-IR, "Frontier" produced by PerkinElmer Japan Co., Ltd.). An attenuated total reflection (ATR) measurement method was adopted as a measurement mode. ATR crystal used was KRS-5 ("L1250046" produced by PerkinElmer Japan Co., Ltd.). A background was measured under conditions of a resolution of 4 $cm^{-1}$, a cumulative number of 8, and an angle of incidence of infrared rays of 45° using the measuring device to which the ATR crystal was fitted, and the FT-IR spectrum (horizontal axis: number of waves of infrared rays used for irradiation, vertical axis: absorbance) of a sample was measured. An area of a first peak originated from C═O stretching of an ester bond and an area of a second peak originated from C═O stretching of an amide bond were calculated from the measured FT-IR spectrum. The first peak appeared around 1,720 $cm^{-1}$. The second peak appeared around 1,600 $cm^{-1}$. An A/E ratio (=(area of second peak)/(area of first peak)) was obtained by dividing the area of the second peak by the area of the first peak.

<Measuring Method of Storage Elastic Moduli $G'_{80}$, $G'_{120}$, and $G'_{150}$>

A pressure of 4 MPa was applied to 0.2 g of a sample (toner) set in a pelleting machine to obtain a columnar pellet having a diameter of 10 mm and a thickness of 2 mm. The obtained pellet was then set in a measuring device. The measuring device used was a rheometer ("Physica MCR-301" produced by Anton Paar). The measuring device included a shaft (specifically, a shaft driven by a motor) having a tip end to which a measurement jig (parallel plate) was mounted. The pellet was placed on a plate (specifically, a heat table hated by a heater) of the measuring device. The pellet (agglomerate of the toner) on the plate was heated up to 110° C. to be once melted. When the toner was entirely melted, the measurement jig (parallel plate) was brought into intimate contact with the melted toner from above so that the toner was interposed between two parallel plates (upper plate: measurement jig, lower plate: heat table). The toner was then cooled down to 40° C. Thereafter, a temperature dependence curve of the storage elastic modulus (vertical axis: storage elastic modulus, horizontal axis: temperature) of the sample (toner) was measured using the measuring device under conditions of a measured temperature range from 40° C. to 200° C., a heating rate of 2° C./minute, and an oscillation frequency of 1 Hz. The storage elastic moduli $G'_{80}$, $G'_{120}$, and $G'_{150}$ at respective temperatures (80° C., 120° C., and 150° C.) were read from the resulting temperature dependence curve of the storage elastic modulus.

[Evaluation Methods]

Each of the samples (toners TA-1 to TA-5 and TB-1 to TB-4) was evaluated by the following methods.

A two-component developer was prepared by mixing 100 parts by mass of a developer carrier (carrier for FS-05250DN) and 5 parts by mass of the sample (toner) for 30 minutes using a ball mill.

The lowest fixing temperature and the highest fixing temperature were evaluated through image formation using the two-component developer prepared as above. An evaluation apparatus used was a color printer including a Roller-Roller type fixing device that applies heat and pressure ("FS-05250DN" produced by KYOCERA Document Solutions Inc., modified as an evaluation apparatus to enable adjustment of fixing temperature). The two-component developer prepared as described above was loaded into a development device of the evaluation apparatus and the sample (toner for replenishment use) was loaded into a toner container of the evaluation apparatus.

A solid image (specifically, unfixed toner image) having a size of 25 mm×25 mm was formed on a part of paper ("$C^2$90" produced by Fuji Xerox Co., Ltd., A4-size plain paper having a weight of 90 g/$m^2$) that ranged 10 mm before the trailing edge of the paper using the evaluation apparatus in an environment at a temperature of 23° C. and a relative humidity of 55% under conditions of a linear velocity of 200 mm/second and a toner application amount of 1.0 mg/$cm^2$. Next, the paper with the image formed thereon was passed through the fixing device of the evaluation apparatus.

The measurement range of the fixing temperature ranged from 100° C. to 200° C. in lowest fixing temperature evaluation. The fixing temperature of the fixing device was increased from 100°C. in increments of 2° C. to measure a minimum temperature at which the solid image (toner image) could be fixed to the paper (lowest fixing temperature). Whether or not the toner could be fixed was confirmed by a fold-rubbing test as described below. Specifically, the fold-rubbing test was performed by folding the evaluation paper having been passed through the fixing device in half such that a surface having the image formed thereon was folded inwards and by rubbing a 1-kg weight covered with cloth back and forth on the fold five times. Next, the paper was opened up and a folded portion of the paper (a portion having the solid image formed thereon) was observed. The length of peeling of the toner (peeling length) in the folded portion was measured. The minimum temperature was determined to be the lowest fixing temperature among fixing temperatures for which the peeling length is not greater than 1 mm. A toner having a lowest fixing temperature of no greater than 110° C. was evaluated as good (Good), and a toner having a lowest fixing temperature of greater than 110° C. was evaluated as poor (Poor).

The measurement range of the fixing temperature ranged from 150° C. to 230° C. in highest fixing temperature evaluation. The fixing temperature of the fixing device was increased from 150° C. in increments of 2° C. to measure a maximum temperature at which offset did not occur (highest fixing temperature). Whether or not offset occurred (toner was attached to a fixing roller) was visually confirmed for the evaluation paper having been passed through the fixing device. A toner having a highest fixing temperature of at least 170° C. was evaluated as good (Good), and a toner having a highest fixing temperature of less than 170° C. was evaluated as poor (Poor).

[Evaluation Results]

Evaluation results for the toners TA-1 to TA-5 and TB-1 to TB-4 are listed in Table 2. Table 2 indicates respective measurement values of low-temperature fixability (lowest fixing temperature) and hot offset resistance (highest fixing temperature).

TABLE 2

| | Toner | Lowest fixing temperature [° C.] | Highest fixing temperature [° C.] |
|---|---|---|---|
| Example 1 | TA-1 | 100 | 170 |
| Example 2 | TA-2 | 100 | 174 |
| Example 3 | TA-3 | 102 | 182 |
| Example 4 | TA-4 | 102 | 188 |
| Example 5 | TA-5 | 108 | 198 |
| Comparative Example 1 | TB-1 | 100 | 160 (Poor) |
| Comparative Example 2 | TB-2 | 112 (Poor) | 168 (Poor) |
| Comparative Example 3 | TB-3 | 100 | 166 (Poor) |
| Comparative Example 4 | TB-4 | 116 (Poor) | 204 |

The toners TA-1 to TA-5 (toners according to Examples 1 to 5) each had the aforementioned basic features. The toner particles of the toners TA-1 to TA-5 each contained a binder resin having an amide bond and an ester bond. Specifically, the binder resin of the toner particles was a po1yester resin into which the amide bond was introduced through the use of the aqueous solution of oxazoline group-containing macromolecule (EPOCROS WS-700). As indicated in Table 1, each of the A/E ratios (an area ratio of the second peak originated from C═O stretching of the amide bond to the first peak originated from C═O stretching of the ester bond in the FT-IR spectrum of a toner obtained by Fourier transform infrared spectroscopy analysis) was at least 0.00010 and no greater than 0.02000. As indicated in Table 1, each of the toners had a storage elastic modulus at a temperature of 80° C. (storage elastic modulus $G'_{80}$) of at least $3.5\times10^4$ Pa and no greater than $5.0\times10^4$ Pa, a storage elastic modulus at a temperature of 120° C. (storage elastic modulus $G'_{120}$) of at least $1.0\times10^3$ Pa and no greater than $1.0\times10^4$ Pa, and a storage elastic modulus at a temperature of 150° C. (storage elastic modulus $G'_{150}$) of at least $1.0\times10^3$ Pa and no greater than $1.0\times10^4$ Pa. As indicated in Table 2, each of the toners TA-1 to TA-5 (toners according to Examples 1 to 5) was excellent in low-temperature fixability and hot offset resistance.

INDUSTRIAL APPLICABILITY

The electrostatic latent image developing toner according to the present invention can be used for image formation using for example a copier, a printer, or a multifunction peripheral.

The invention claimed is:

1. An electrostatic latent image developing toner comprising a plurality of toner particles containing a binder resin, wherein the binder resin has an amide bond and an ester bond, an area ratio of a peak originated from C═O stretching of the amide bond to a peak originated from C═O stretching of the ester bond is at least 0.00010 and no greater than 0.02000 in a FT-IR spectrum of the toner obtained by Fourier transform infrared spectroscopy analysis, the toner has a storage elastic modulus at a temperature of 80° C. of at least $3.5\times10^4$ Pa and no greater than $5.0\times10^4$ Pa, the toner has a storage elastic modulus at a temperature of 120° C. of at least $1.0\times10^3$ Pa and no greater than $1.0\times10^4$ Pa, and the toner has a storage elastic modulus at a temperature of 150° C. of at least $1.0\times10^3$ Pa and no greater than $1.0\times10^4$ Pa.

2. The electrostatic latent image developing toner according to claim 1, wherein the toner particles contain as the binder resin a polyester resin having the ester bond and a polymer of a vinyl compound bonded to the polyester resin through the amide bond.

3. The electrostatic latent image developing toner according to claim 1, wherein the toner particles contain a polyester resin having the ester bond and a polymer including a repeating unit represented by the following formula (1-1), and the polyester resin and the polymer are bonded together in form represented by the following formula (1-2) through ring opening of oxazoline groups in at least a portion of molecules of the repeating unit that is represented by the formula (1-1) in the polymer:

(1-1)

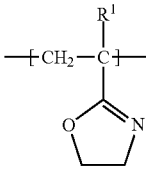

[in the formula (1-1), $R^1$ represents a hydrogen atom or an optionally substituted alkyl group], (1-2)

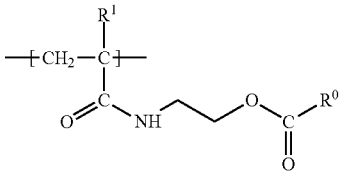

[in the formula (1-2), $R^1$ represents the same group as $R^1$ in the formula (1-1) and "$R^0$—COO—" represents a terminal of an acid component of the polyester resin].

4. The electrostatic latent image developing toner according to claim 1, wherein the binder resin has a cross-linking structure formed through a covalent bonding of a nitrogen atom in the amide bond and a cross-linking structure formed through hydrogen bonding of an oxygen atom in the ester bond.

5. The electrostatic latent image developing toner according to claim 1, wherein an absolute value of a difference between the storage elastic modulus of the toner at a temperature of 120° C. and that of the toner at a temperature of 150° C. is no greater than $1.0\times10^3$ Pa.

6. The electrostatic latent image developing toner according to claim 5, wherein a value obtained by subtracting the storage elastic modulus of the toner at a temperature of 150° C. from that of the toner at a temperature of 120° C. is at least $+0.1\times10^3$ Pa and no greater than $+0.3\times10^3$ Pa.

7. The electrostatic latent image developing toner according to claim 5, wherein an absolute value of a difference between the storage elastic modulus of the toner at a temperature of 80° C. and that of the toner at a temperature of 120° C. is at least $3.0\times10^4$ Pa.

8. The electrostatic latent image developing toner according to claim 7, wherein the toner has a storage elastic modulus at a temperature of 120° C. of at least $2.0\times10^3$ Pa and no greater than $5.0\times10^3$ Pa, and the toner has a storage elastic modulus at a temperature of 150° C. of at least $1.0\times10^3$ Pa and no greater than $5.0\times10^3$ Pa.

9. The electrostatic latent image developing toner according to claim 1, wherein the toner particles each include a toner mother particle, the toner mother particle containing a polymer including an oxazoline group at a ratio of at least 0.05% by mass and no greater than 7.00% by mass, and the electrostatic latent image developing toner is a pulverized toner.

10. The electrostatic latent image developing toner according to claim 1, wherein the toner particles contain no crystalline polyester resin, and the electrostatic latent image developing toner is a positively chargeable toner.

* * * * *